US005521142A

United States Patent [19]

Landgrebe et al.

[11] Patent Number: 5,521,142

[45] Date of Patent: May 28, 1996

[54] THERMAL TRANSFER DYE DONOR ELEMENT

[75] Inventors: Kevin D. Landgrebe; Terrance P. Smith, both of Woodbury; Jeffrey C. Chang, North Oaks, all of Minn.

[73] Assignee: Minnesota Mining and Manufacturing Company, St. Paul, Minn.

[21] Appl. No.: 528,439

[22] Filed: Sep. 14, 1995

[51] Int. Cl.[6] ..... B41M 5/035; B41M 5/38

[52] U.S. Cl. ..... 503/227; 428/195; 428/913; 428/914

[58] Field of Search ..... 8/471; 428/195, 428/913, 914

[56] References Cited

U.S. PATENT DOCUMENTS

| | | | |
|---|---|---|---|
| 3,586,616 | 6/1971 | Kropp | 204/159.11 |
| 3,898,086 | 8/1975 | Franer et al. | 96/28 |
| 4,018,810 | 4/1977 | Skoog | 260/465 D |
| 4,701,439 | 10/1987 | Weaver et al. | 503/227 |
| 4,808,568 | 2/1989 | Gregory et al. | 503/227 |
| 4,833,123 | 5/1989 | Hashimoto et al. | 503/227 |
| 4,857,503 | 8/1989 | Jongewaard et al. | 428/207 |
| 4,923,846 | 5/1990 | Kutsukake et al. | 503/227 |
| 4,999,026 | 5/1991 | Albert et al. | 8/471 |
| 5,141,915 | 8/1992 | Roenigk et al. | 503/227 |
| 5,198,323 | 5/1993 | Kitao et al. | 430/191 |
| 5,223,476 | 6/1993 | Kanto et al. | 503/227 |
| 5,304,528 | 4/1994 | Kanto et al. | 503/227 |

FOREIGN PATENT DOCUMENTS

| | | | |
|---|---|---|---|
| 1148096 | 7/1986 | Japan | 503/227 |
| 2-292371 | 12/1990 | Japan | 503/227 |
| 3-086591 | 4/1991 | Japan | 503/227 |
| 2083726 | 9/1981 | United Kingdom | 503/227 |

*Primary Examiner*—Bruce Hess

*Attorney, Agent, or Firm*—Gary L. Griswold; Walter N. Kirn; Gregory A. Evearitt

[57] ABSTRACT

A thermal transfer dye donor element containing at least one substrate coated with a layer containing binder and at least one β -cyano-β-trifluoromethanesulfonyl-p-N,N-dialkylaminostyrene yellow dye. Also disclosed is a process for the imagewise transfer of the yellow dye to a receiving element.

10 Claims, No Drawings

THERMAL TRANSFER DYE DONOR ELEMENT

FIELD OF THE INVENTION

This invention relates to novel thermal dye donor elements and in particular it relates to dye donor elements based on β -cyano-β-trifluoromethanesulfonyl-p-N,N-dialkylaminostyrene yellow dyes.

BACKGROUND

The term "thermal transfer printing" covers two main areas of technology. In thermal transfer printing of textiles, a donor sheet is coated with a pattern of one or more dyes, contacted with the fabric to be printed, and heat is uniformly administered, sometimes with concomitant application of a vacuum. The transfer process has been much studied and it is generally accepted that the dyes are transferred by sublimation in the vapor phase. See, e.g., C. J. Bent et al., *J. Soc. Dyers Colour.*, 85, 606 (1969); J. Griffiths and F. Jones, ibid., 93, 176, (1977); J. Aihara et al., *Am. Dyest. Rep.*, 64, 46, (February, 1975); and C. E. Vellins in "The Chemistry of Synthetic Dyes", K. Venkataraman, ed., Vol. VIII, 191, Academic Press, New York, 1978.

The other area covered by the term thermal transfer printing is thermal imaging where heat is applied in an imagewise fashion to a donor sheet in contact with a suitable receptor sheet to form a colored image on the receptor. In one type of thermal imaging, termed thermal mass transfer printing as described, for example, in U.S. Pat. No. 3,898,086, the donor is a colorant dispersed in a wax-containing coating. On the application of heat, a donor layer in the construction melts or is softened, and a portion of the colored donor coating transfers to the receptor. Despite problems with transparency, pigments are generally the colorants of choice to provide sufficient light fastness of the colored image on the receptor. Another type of thermal printing is termed thermal dye transfer imaging or recording or dye diffusion thermal transfer. There, the donor sheet contains a dye in a binder. On imagewise application of heat, the dye, but not the binder, is transferred to the receptor sheet. A recent review has described the transfer mechanism as a "melt state" diffusion process quite distinct from the sublimation attending textile printing. See P. Gregory, *Chem. Brit.*, 25, 47 (1989).

This same review emphasizes the great difficulty of finding or synthesizing dyes suitable for diffusive thermal transfer, stating that "It is significant that of the one million or so dyes available in the world, none were fully satisfactory." Among the failings of the dyes are inadequate light and heat fastness of the image and insufficient solubility of dyes for coating in the donor sheet. As has been noted previously, light fastness is also a problem in mass transfer imaging systems. In fact, achieving adequate light fastness is probably the single biggest challenge in these constructions. In large measure this is the result of the diffusive thermal transfer dye image being a surface coating a few microns thick. The dye is thus readily susceptible to photooxidative degradation. In contrast, textile fibers, which are 100 times thicker, are uniformly dyed throughout their depth, so that fading in the first few microns at the surface is of little practical importance. Consequently, it is common to find that dyes showing good light fastness in textile printing exhibit very poor photostability in diffusive thermal transfer imaging (see, e.g., U.S. Pat. No. 4,808,568) and thus, there remains a strong need for improved dyes for the latter application.

The thermal printing art in teaching the use and production of full color images [*Mitsubishi Kasei R & D Review*, 3, (2), 71–80 (1989)] states that "in order to achieve a recorded good showing wide color reproduction range, it is necessary that the absorption spectral characteristics of the three primary color dyes be correct." It is noted that "each dye should absorb one-third of the visible wavelength band while allowing the remaining two-thirds to be transmitted, and show high color purity, which does not allow overlapping of each absorption." Additionally, the art (i.e., U.S. Pat. No. 4,923,846) teaches that ". . . in heat transfer recording, if the color characteristics of the three colors of cyan, magenta, and yellow are not [low], the intermediate colors become turbid colors with low chroma, whereby no good color reproducibility can be obtained."

Although thermal printing of textiles bears a superficial resemblance to diffusive thermal dye imaging, they are in reality quite different processes with distinct properties and material requirements involved. Thermal printing occurs by a sublimation process, so that substantial vapor pressure is a prime criterion for dye selection. In diffusive dye imaging, high vapor pressure of the dye contributes to undesirable thermal fugacity of the image. For the melt state diffusion process involved in this situation, melting point is instead a better basis for dye selection. Diffusive dye transfer is a high resolution dry imaging process in which dye from a uniform donor sheet is transferred in an imagewise fashion by differential heating to a very smooth receptor, using heated areas typically of 0.0001 square inches or less. In contrast, the thermal printing of textiles is of comparatively low resolution, involving contemporaneous transfer by uniform heating of dye from a patterned, shaped or masked donor sheet over areas of tens of square feet. The typical receptors printed in this manner are woven or knitted fabrics and carpets. The distinct transfer mechanism allows such rough substrates to be used, while diffusive thermal dye imaging, where receptors with a mean surface roughness of less than 10 microns are used, is unsuitable for these materials.

Unlike diffusive thermal dye imaging, the transfer printing process is not always a dry process; some fabrics or dyes require pre-swelling of the receptor with a solvent or a steam post-treatment for dye fixation. Though the transfer temperatures for the two processes can be similar (180° to 220° C.), diffusive dye transfer generally operates at somewhat higher temperatures. However, in a manner strikingly reflective of the differences in mechanism involved, diffusive dye transfer involves times of around 5 msec, whereas thermal printing normally requires times of 15 to 60 sec. In accord with the sublimation process involved, thermal printing often benefits from reduced atmospheric pressure or from flow of heated gas through the donor sheet. Thermal printing is a technology developed for coloring of textiles and is used to apply uniformly colored areas of a predetermined pattern to rough substrates. In contradistinction, diffusive dye transfer is a technology intended for high quality imaging, typically from electronic sources. Here, a broad color gamut is built with multiple images from donors of the three primary colors onto a smooth receptor. The different transfer mechanism allows the requirement for gray scale capability to be fulfilled, since the amount of dye transferred is proportional to the heat energy applied. In thermal printing, gray scale capability is expressly shunned because sensitivity of transfer to temperature decreases process latitude and dyeing reproducibility.

U.S. Pat. Nos. 5,223,476 and 5,304,528 disclose dyes for thermal printing that have two vinyl aniline moieties joined by a linking group, each vinyl aniline moiety containing two "electron withdrawing groups" at the terminus of the double bond. While β-cyano-β-ethylsulfonyl- and β-cyano-β-arylsulfonyl-p-dialkylaminostyrenes are used in examples, no disclosure is made of β-cyano-β-trifluoromethanesulfonyl-p-aminostyrenes. Japanese Patent Publication No. JP 2-292371 describes similar styryl dyes for thermal printing, the β-cyano-β-ethylsulfonyl group again being exemplified. Japanese Patent Publication No. 3-086591 describes magenta dyes for thermal printing that comprise the α,β-dicyano-β-sulfonamide moiety. Neither Japanese patent mentions any potential advantage or utility of β-cyano-β-trifluoromethanesulfonyl-containing aminostyryl dyes. Furthermore, while the bis(trifluoromethanesulfonyl)-p-dialkyaminostyryl dyes are disclosed for use in thermal printing as eutectic mixtures with other dyes in U.S. Pat. No. 4,857,503, and the β,β-dicyano-p-dialkylaminostyryl dyes are disclosed for use in thermal transfer printing in a number of patents, including U.S. Pat. Nos. 4,833,123; 4,701,439; and 4,999,026, there is no mention in any of these documents that the "mixed" version of the dyes, i.e., the β-cyano-β-trifluoromethanesulfonyl-p-dialkylaminostyrenes, may have improved light fastness, lower hue error, and lower turbidity as thermal printing donor element dyes.

SUMMARY OF THE INVENTION

In accordance with the present invention, it has now been discovered that β-cyano-β-trifluoromethanesulfonyl-p-N,N-dialkylaminostyrene yellow dyes can be beneficially used in thermal dye transfer imaging. When these dyes are used to prepare yellow dye donor constructions, the resultant transferred images exhibit improved light fastness, lower hue error, and lower turbidity over comparable materials.

Thus, in one embodiment, the present invention provides a thermal dye transfer donor element comprising a substrate coated on one side with a layer comprising binder and at least one β-cyano-β-trifluoromethanesulfonyl-p-N,N-dialkylaminostyrene yellow dye wherein the alkyl substituent is an alkyl group.

In another embodiment, the present invention provides a process which comprises the steps of: (a) placing the above-disclosed, inventive thermal transfer dye donor element in contact with a dye receptor element; and (b) heating the thermal transfer dye donor element in an imagewise fashion, thereby resulting in transfer of β-cyano-β-trifluoromethanesulfonyl-p-N,N-dialkylaminostyrene dye to the receptor element.

As is well understood in this area, substitution is not only tolerated, but is often advisable and substitution is anticipated on the compounds used in the present invention. As a means of simplifying the discussion and recitation of certain substituent groups, the terms "group" and "moiety" are used to differentiate between those chemical species that may be substituted and those which may not be so substituted. Thus, when the term "group," or "aryl group," is used to describe a substituent, that substituent includes the use of additional substituents beyond the literal definition of the basic group. Where the term "moiety" is used to describe a substituent, only the unsubstituted group is intended to be included. For example, the phrase, "alkyl group" is intended to include not only pure hydrocarbon alkyl chains, such as methyl, ethyl, propyl, t-butyl, cyclohexyl, iso-octyl, octadecyl and the like, but also alkyl chains bearing substituents known in the art, such as hydroxyl, alkoxy, phenyl, halogen atoms (F, Cl, Br, and I), cyano, nitro, amino, carboxy, etc. For example, alkyl group includes ether groups (e.g., $CH_3$—$CH_2$—$CH_2$—O—$CH_2$—), haloalkyls, nitroalkyls, carboxyalkyls, hydroxyalkyls, sulfoalkyls, etc. On the other hand, the phrase "alkyl moiety" is limited to the inclusion of only pure hydrocarbon alkyl chains, such as methyl, ethyl, propyl, t-butyl, cyclohexyl, iso-octyl, octadecyl, and the like. Substituents that react with active ingredients, such as very strongly electrophilic or oxidizing substituents, would of course be excluded by the ordinarily skilled artisan as not being inert or harmless.

Other aspects, advantages, and benefits of the present invention are apparent from the detailed description, examples, and claims.

DETAILED DESCRIPTION OF THE INVENTION

The process of dye diffusion thermal transfer involves intimately contacting a dye donor sheet with a suitable receptor sheet and applying heat in an imagewise fashion to transfer the dye to the receptor. Generally, the transfer process involves temperatures from 150° C. up to 400° C. and times of a few milliseconds (e.g., from 1 to 100 milliseconds). Although if a laser is used as a heat source, as described, for example, in GB 2,083,726, the heating times can be as short as 50 nanoseconds. In addition to providing an image of acceptable density and of correct color, the dye must provide good light fastness and heat stability in the image. It is particularly desirable that the dye transfers in proportion to the heat applied so that a good gray scale of coloration can be obtained.

The preferred dyes useful in the present invention are represented by formula (I):

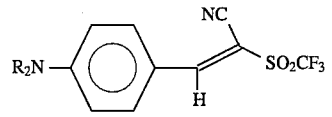

(I)

wherein: each R independently represents an alkyl group of up to 20, inclusive, carbon atoms; preferably of up to 10, inclusive, carbon atoms; and more preferably, of up to 6, inclusive carbon atoms. Examples of alkyl groups include, but are not limited to, methyl, ethyl, hexyl, cyclohexyl, iso-octyl, hydroxyethyl, omega-chlorohexyl, 2-ethoxydodecyl, and the like. It is preferred that the dyes be free of ionizable or ionic water-solubilizing groups such as sulfo and carboxy and their salts.

The donor element may have a variety of structures, including a self-supporting single layer or a layer or coating on various substrates in combination with other layers, and may be used in a number of different imaging processes, including imaging with thermal printheads and with lasers.

The dye donor constructions of this invention provide transferred dye images that have excellent light fastness, high density, low hue error, and low turbidity. The dye donor element is coated with a layer containing dye and binder on a suitable substrate, though a self-sustaining film containing the dye is also possible. The carrier sheet is preferably flexible, but may be rigid if the receptor layer is sufficiently flexible and/or conformable. Examples of substrates include glass, ceramic, metal, metal oxide, fibrous materials, paper, polymers, resins, and mixtures or layers of these materials. Polymeric films are often preferred.

For backside thermal exposure with a thermal printhead, examples of substrates include polyester, polyimide, polyamide, polyacrylate, polyalkylene and cellulosic films, and paper, especially the uniform high-quality paper known as condenser paper. It may be desirable to apply a backsize to the substrate on the side away from the dye to protect it from the heat source or to prevent sticking to the thermal element. (See, for example, U.S. Pat. No. 5,141,915.) The thickness of the resultant substrate may vary within wide limits depending on its thermal properties, but is generally below 50 microns; preferably, less than 12 microns; and more preferably, less than 10 microns. If a front thermal exposure is used, for instance when a laser irradiates the dye through a transparent receptor sheet, the thickness of the substrate is not critical.

The dye donor element contains at least one β-cyano-β-trifluoromethanesulfonyl-p-N,N-dialkylaminostyrene yellow dye (wherein the alkyl substituent is an alkyl group) and a suitable binder. Other additives such as plasticizers, stabilizers, thermal absorbers, radiation absorbers, or surfactants may also be present, as is known in the art.

Suitable binders are polymeric materials such as polyvinyl chloride and its derivatives; polyesters; celluloses, such as cellulose acetate, cellulose acetate butyrate, ethyl cellulose and the like; epoxy resins; acrylates, such as polymethyl methacrylate; vinyl resins such as polyvinyl acetate, polyvinyl butyral, poly(vinyl pyrrolidone) and poly(vinyl alcohol); polyurethanes; polysiloxanes; copolymers, such as those derived from polyacrylates or polyalkylene materials; and blends or mixtures of these various polymers.

The dye may be present in the binder in the dissolved state, or it may be dispersed with at least some crystalline dye present.

Generally, from about 15–99 wt. % yellow dye, and preferably from about 15–90 wt. % yellow dye, is used in the layer containing yellow dye and binder, based upon the total weight of the layer. A preferred range is from 70% to 40% by weight of dye in multilayer constructions. A self-supporting element (e.g., without a distinct carrier layer) may contain 20% by weight of binder and preferably, as much as 40% by weight of binder.

In general, it is desired to formulate the donor element such that the dye, but substantially none of the donor element binder, is transferred to the receptor. However, in some cases valuable constructions can be prepared in which the dye along with a significant, or indeed major, portion of the binder is transferred in a mass transfer process.

The receptor sheet may be transparent, translucent or opaque. It may be a single layer or a laminate. Particularly useful constructions can be made when the receptor is applied to a transparent polyester film or to a paper substrate. The receptor sheet may comprise a wide variety of polymers or their mixtures. Suitable materials are similar to those outlined above for the binder of the donor sheet. Especially useful results can be obtained with receptors where the major component is sulfonated, hydroxy and epoxy functional vinyl chloride copolymer (e.g., MR-120, Nippon Zeon Corporation). The receptor may additionally contain various additives, such as heat and light stabilizers or coating aids. While the exact nature of the receptor may influence the quality and fastness of the image, it has been found that the excellent stability of the dye mixtures of this invention is a property of the dye image itself and not of the receptor composition.

EXAMPLES

The performance of the dyes used in this invention in diffusive thermal imaging systems is demonstrated in the following non-limiting examples, with particular reference to image light stability, yellow image density, and image hue error and turbidity.

The values for hue error and turbidity are obtained following the evaluation method of GATF (Graphic Arts Technical Foundation), the details of which are described, for example, in GATF-Bulletin 509 "Color Separation Photography." Briefly, the evaluation method compares the deviation of the ideal color of a process ink to that of the practical color by use of the density values obtained by three kinds of filters of blue, green, and red, and is the method broadly used in the field of printing. In this method, density value is calculated from the reflectance of the measured light when passing through the filter. When the lowest density value L (Low), the highest density value H (High), and the middle density value M (Middle) is made, the hue error and turbidity can be calculated from the following equations:

$$\text{Hue error}=(M-L/H-L)\times 100\%$$

$$\text{Turbidity}=(L/H)\times 100\%$$

The following is a description of the various coating formulations referred to in the examples. All donor dyes were coated with a number 12 wire-wound coating rod (0.027 mm wet thickness) onto 4.5 micron Toyo Metallizing TTR-101™ (TR-101) thermal transfer backside coating system, which is representative of a thin polyester film, and dried in a current of air at ambient temperature. DNP T-1 receptor sheets were obtained commercially from Dai Nippon Printing, Tokyo, Japan.

Geon 178™ PVC was purchased from BF Goodrich, Cleveland, Ohio. Vitel PE-200™ polyester was purchased from Goodyear Tire and Rubber Company, Akron, Ohio. Troysol CD-1™ was purchased from Troy Chemical Corporation, Newark, N.J. Tetrahydrofuran was purchased from Baxter Healthcare Corporation, Muskegon, Mich., and contained 250 ppm BHT (butylated hydroxytoluene) as preservative. Troysol CD-1™ (CAS Reg. No. 64742-88-7, Troy Chemical, Newark, N.J.) was used as a dispersing agent.

The dicyano-, bis(phenylsulfonyl)-, and cyanosulfonylaminostyryl dyes can be prepared using N,N-diethylaminobenzaldehyde and the appropriate active methylene compound according to procedures disclosed in U.S. Pat. No. 5,198,323. The bis(trifluoromethanesulfonyl)aminostyryl dyes can be prepared according to the procedure described in U.S. Pat. No. 4,018,810. The following dye intermediates can be purchased from Aldrich Chemical Co., Milwaukee, Wis.: N,N-diethylaminobenzaldehyde, bis(phenylsulfonyl-)methane, phenylsulfonylacetonitrile, and malononitrile. Methanesulfonylacetonitrile can be purchased from Johnson Matthey Catalog Co., Ward Hill, Mass. Trifluoromethanesulfonylacetonitrile and nonafluorobutanesulfonylacetonitrile can be prepared according to the procedure described in *Synthesis*, 12, (1991), pages 1205–1208. Bis-(trifluoromethylsulfonyl)methane can be prepared according to the procedure disclosed in U.S. Pat. No. 3,586,616.

Donor Sheets

Donor sheets were made using the following formulation:

Coating solution

| Weight percent | Ingredient |
|---|---|
| 1.77 | dye |
| 1.61 | Geon 178 PVC |
| 0.11 | Vitel PE-200 polyester |
| 0.65 | Troysol CD-1 dispersing agent |

-continued

| Coating solution | |
|---|---|
| Weight percent | Ingredient |
| 90.03 | tetrahydrofuran |
| 5.83 | methyl ethyl ketone |

Receptor Sheet

The receptor was 3M Desktop™ Color Proofing Base, which was used as received, with dye transfer to the coated side.

Printer

The printer used was that employed in the 3M Rainbow™ Desktop Color Proofing System.

Example 1 (Inventive)

Donor sheet I, prepared as described above using dye of the formula disclosed earlier herein (I) (wherein R=ethyl) was imaged onto the receptor sheet using the desktop printer described above. The image densities (ROD) using each of the blue, green, and red filters were measured so that hue error and turbidity could be calculated. The transferred images were then exposed in a light box at 5000 flux for 168 hours at 25° C. The percent change in density (measured using blue filter) after 168 hours was determined. The samples were then exposed in the same light box for an additional 168 hours at 25° C. and the percent change in density was determined again. The results are disclosed in Table I.

Example 2 (Comparative)

Donor sheet II, prepared as described above except using dye (II), was imaged and tested in the same way as described for donor sheet I in Example 1. The results are disclosed in Table I.

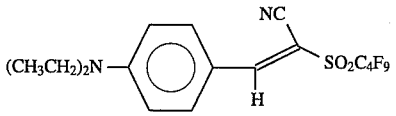

Example 3 (Comparative)

Donor sheet III, prepared as described above except using dye (III), was imaged and tested in the same way as described for donor sheet I in Example 1. The results are disclosed in Table I.

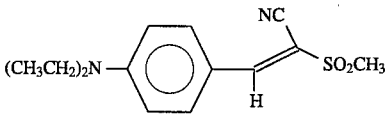

Example 4 (Comparative)

Donor sheet IV, prepared as described above except using dye (IV), was imaged and tested in the same way as described for donor sheet I in Example 1. The results are disclosed in Table I.

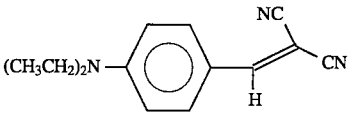

Example 5 (Comparative)

Donor sheet V, prepared as described above except using dye (V), was imaged and tested in the same way as described for donor sheet I in Example 1. The results are disclosed in Table I.

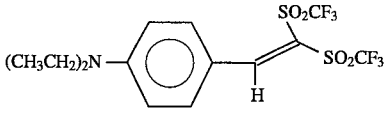

Example 6 (Comparative)

Donor sheet VI, prepared as described above except using dye (VI), was imaged and tested in the same way as described for donor sheet I in Example 1. The results are disclosed in Table I.

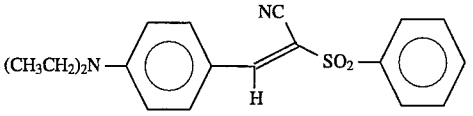

Example 7 (Comparative)

Donor sheet VII, prepared as described above except using dye (VII), was imaged and tested in the same way as described for donor sheet I in Example 1. The results are disclosed in Table I.

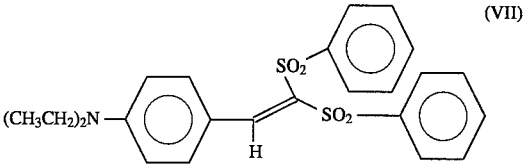

TABLE I

| Example | density[1] | % ROD change[2] | % ROD change[3] | initial hue error | initial turbidity |
|---|---|---|---|---|---|
| 1 | 0.87 | 0 | 3.4 | 1.2 | 1.1 |
| 2 | 0.95 | 14.7 | 27.4 | 10.6 | 1.1 |
| 3 | 0.41 | 2.4 | 7.3 | 0 | 2.4 |
| 4 | 0.79 | 5.0 | 10.1 | 14.1 | 1.3 |
| 5 | 0.40 | 5.0 | 15.0 | 5.0 | 0 |
| 6 | 0.56 | 8.9 | 16.1 | 0 | 3.6 |
| 7 | 0.44 | 15.9 | 15.9 | 2.3 | 4.5 |

[1]Initial, yellow component
[2]After 168 hours aging
[3]After 336 hours aging

The results in Table 1 show that dye (I) has the lowest reflective optical density (ROD)% change after 168 and 336 hours aging of any of the dyes tested. The additional features of low turbidity and hue error and good density indicate that dye (I) is superior to the dyes used in Examples 2–7 for thermal transfer printing. This result is surprising, since the closely related dye (II) has much poorer light stability and hue error, and closely related dye (III) has a density too low to be useful in thermal transfer printing as well as poorer light stability and turbidity. The dicyano derivative (IV) is a worse thermal transfer dye than (I) in all aspects, and the bis(trifluoromethanesulfonyl) derivative (V) performed poorer in all characteristics tested, except for turbidity. Dyes (VI) and (VII) performed poorer than dye (I) in all respects, except that dye (VI) had a hue error of zero.

Reasonable variations and modifications are possible from the foregoing disclosure without departing from either the spirit or scope of the present invention as defined in the claims.

What is claimed is:

1. A thermal transfer dye donor element comprising at least one substrate coated with a layer comprising binder and at least one β-cyano-β-trifluoromethanesulfonyl-p-N,N-di-alkylaminostyrene yellow dye wherein the alkyl substituent is an alkyl group.

2. The thermal transfer dye donor element of claim 1 wherein said at least one yellow dye is represented by the following formula:

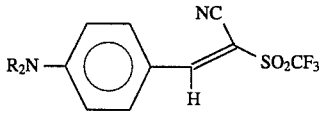

wherein: each R independently represents an alkyl group having up to 20 carbon atoms, inclusive, and said at least one yellow dye is present in said layer in an amount of from about 15–99 wt. %, based upon the total weight of said layer comprising said yellow dye and binder.

3. The thermal transfer dye donor element of claim 2 wherein each R independently represents an alkyl group of up to 10 carbon atoms, inclusive.

4. The thermal transfer dye donor element of claim 2 wherein each R independently represents an alkyl group of up to 6 carbon atoms, inclusive.

5. The thermal transfer dye donor element of claim 2 wherein said yellow dye is present in said layer in an amount of from about 15–90 wt. %, based upon the total weight of said layer comprising said yellow dye and binder.

6. The thermal transfer dye donor element of claim 1 wherein said substrate has a thickness of less than 50 microns.

7. A process comprising the steps of: (a) placing the thermal transfer dye donor element of claim 1 in contact with a dye receptor element; and (b) imagewise heating the thermal transfer dye donor element, thereby resulting in the transfer of yellow dye from said donor element to said receptor element.

8. The process of claim 7 wherein said heating in step (b) is conducted at a temperature of from about 150° to 400° C. for about 0.1 to 100 milliseconds.

9. A process comprising the steps of: (a) placing the thermal transfer dye donor element of claim 2 in contact with a dye receptor element; and (b) imagewise heating the thermal transfer dye donor element, thereby resulting in transfer of yellow dye from said donor element to said receptor element.

10. The process of claim 9 wherein said heating in step (b) is conducted at a temperature of from about 150° to 400° C. for about 0.1 to 100 milliseconds.

* * * * *